US009630681B2

(12) United States Patent
Zijlmans et al.

(10) Patent No.: US 9,630,681 B2
(45) Date of Patent: Apr. 25, 2017

(54) DEVICE FOR AND METHOD OF TENSIONING CHAINS, IN PARTICULAR MOORING LEGS

(71) Applicant: IHC HOLLAND IE B.V., Sliedrecht (NL)

(72) Inventors: Jurgen Arjan Zijlmans, Barendrecht (NL); Petrus Marinus Johannes Van Der Burgt, Horssen (NL); Joppe Burgers, Nijmegen (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 14/346,172

(22) PCT Filed: Sep. 19, 2012

(86) PCT No.: PCT/NL2012/050662
§ 371 (c)(1),
(2) Date: Mar. 20, 2014

(87) PCT Pub. No.: WO2013/043049
PCT Pub. Date: Mar. 28, 2013

(65) Prior Publication Data

US 2014/0224163 A1 Aug. 14, 2014

(30) Foreign Application Priority Data

Sep. 23, 2011 (NL) ..... 2007463

(51) Int. Cl.
*B63B 21/04* (2006.01)
*B63B 21/20* (2006.01)
(Continued)

(52) U.S. Cl.
CPC ..... *B63B 21/04* (2013.01); *B63B 21/18* (2013.01); *B63B 21/20* (2013.01); *B63B 21/502* (2013.01); *B63B 2021/003* (2013.01)

(58) Field of Classification Search
CPC ..... B63B 21/04; B63B 21/20; B63B 21/502
(Continued)

(56) References Cited

U.S. PATENT DOCUMENTS 3,664,122 A * 5/1972 Linnenbank ..... F16G 15/02 59/85
4,559,890 A * 12/1985 Regalbuto ..... B23K 7/00 114/221 R
(Continued)

FOREIGN PATENT DOCUMENTS

DE 202007004526 5/2007
GB 1457711 12/1976
(Continued)

OTHER PUBLICATIONS

International Search Report and Written Opinion from corresponding foreign application PCT/NL2012/050662 filed Sep. 19, 2012.
(Continued)

*Primary Examiner* — Lars A Olson
*Assistant Examiner* — Jovon Hayes
(74) *Attorney, Agent, or Firm* — Steven M. Koehler; Westman, Champlin & Koehler, P.A.

(57) ABSTRACT

A device for tensioning anchor chains, in particular mooring legs of off-shore vessels and installations, comprises a frame carrying connectors for holding together lower and upper portions of the chain to be tensioned. The frame further carries a tensioning mechanism for pulling at least one portion of the chain towards the other portion of the chain while the device is submerged.

22 Claims, 6 Drawing Sheets

(51) Int. Cl.
*B63B 21/50* (2006.01)
*B63B 21/18* (2006.01)
*B63B 21/00* (2006.01)

(58) Field of Classification Search
USPC ..... 114/230.22, 230
See application file for complete search history.

(56) References Cited

U.S. PATENT DOCUMENTS 5,524,566 A * 6/1996 Rapa ..... B63B 21/00 114/214
5,934,216 A * 8/1999 Childers ..... B63B 21/04 114/200
6,112,691 A * 9/2000 Bajeli ..... B63B 21/20 114/215
7,240,633 B2 * 7/2007 Barlow ..... B63B 21/04 114/200
7,421,967 B1 * 9/2008 Fontenot ..... B63B 21/507 114/200
8,683,935 B2 * 4/2014 Bauduin ..... B63B 21/502 114/221 R
9,003,994 B2 * 4/2015 Leverette ..... B63B 21/00 114/199
2002/0084449 A1 * 7/2002 Hovik ..... B66D 1/72 254/264
2006/0060126 A1 * 3/2006 Dove ..... B63B 21/04 114/293
2006/0213418 A1 * 9/2006 Boatman ..... B63B 21/10 114/230.1
2012/0031320 A1 * 2/2012 Bauduin ..... B63B 21/502 114/264
2014/0224163 A1 * 8/2014 Zijlmans ..... B63B 21/04 114/230.22

FOREIGN PATENT DOCUMENTS

WO 2008024527 2/2008
WO 2011091995 8/2011

OTHER PUBLICATIONS

Chinese Office Action for Chinese patent application No. 201280045706.9, dated Oct. 9, 2016.

* cited by examiner

DEVICE FOR AND METHOD OF TENSIONING CHAINS, IN PARTICULAR MOORING LEGS

CROSS-REFERENCE TO RELATED APPLICATION

This application is a Section 371 National Stage Application of International Application PCT/NL2012/050662 filed Sep. 19, 2012 and published as WO 2013/043049 A1 in English.

BACKGROUND

The discussion below is merely provided for general background information and is not intended to be used as an aid in determining the scope of the claimed subject matter.

Aspects of the invention relate to a device for tensioning anchor chains, in particular mooring legs of off-shore vessels, such as FPSOs, and installations, such as oil rigs, comprising a frame carrying connectors for holding together lower and upper portions of the chain to be tensioned. Aspects of the invention further relates to a method of tensioning anchor chains.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background An aspect of the present invention provides a device for tensioning chains that does not require a chain tensioning mechanism, such as a winch, on board any surface vessel and/or that can be re-used, i.e. used to tension more than one chain.

To this end, the device includes a frame that further carries a tensioning mechanism for pulling at least one portion of the chain towards the other portion of the chain while the device is submerged.

Thus, the device temporarily forms a link in the chain and no tensioning winch or jack is required on the ship to be moored or on an anchor handling vessel.

In an embodiment, the connectors for the lower and upper portions of the chain both releasably engage the chain during holding. Thus, the tensioning device can be removed from the tensioned chain and (re-)used to tension further chains.

In a further embodiment, at least one of the connectors comprises a chain stopper, e.g. a pawl or pair of pawls operated by means of a spring and/or a hydraulic cylinder.

Although the tensioning mechanism can take many forms, such as a winch combined with at least one chain stopper, it is preferred that the tensioning mechanism comprises one or more, e.g. two parallel, jacks, such as hydraulic cylinders, a first chain stopper fixed relative to one end of the jack(s) and a second chain stopper fixed relative to the other end of the jack(s). Such a mechanism can be kept compact and configured to exert a pulling force that is in line with the lower and upper portions of the chain.

In an embodiment, the frame carries a chain handling mechanism, in particular a wildcat associated with driving means, for guiding the pulled-in chain away from the tensioning mechanism and preferably for generating a pre-tension in the chain at least between the handling and tensioning mechanisms.

In a further embodiment, the frame carries a cutter, such as a blade saw or diamond wire, for separating pulled-in chain from the tensioned portion of the chain, a mechanism for aligning and interconnecting the ends of the lower and upper portions of the chain, and, preferably, a power pack and controls. Thus, all tools for tensioning, chain handling, chain cutting and interconnecting the lower and upper portions of the chain are integrated in a single, submersible and re-usable device.

In an embodiment, the end of one of the portions of the chain comprises an openable link, e.g. a D-shackle. In another embodiment, the ends of the chain are interconnected by a permanent e.g. a welded link.

In a more detailed embodiment, the aligning mechanism comprises a movable sub-frame and a means for interconnecting the ends of the lower and upper chain portions, e.g. an hydraulic cylinder for closing the pin of a D-shackle. Thus, after cutting, the ends of the chain can be moved relative to each other, aligned to facilitate interconnecting the ends, and interconnected.

An aspect of the invention further relates to a method of tensioning an anchor chain, in particular a mooring leg of an off-shore vessel or installation, comprising the steps of releasably connecting lower and upper portions of the chain to a tensioning device, preferably a device as described above, the tensioning device thus temporarily forming a link in the chain, and tensioning the portions of the chain with the tensioning device while it is submerged.

In an embodiment, the chain is tensioned by pulling the portions of the chain towards each other.

BRIEF DESCRIPTION OF THE DRAWINGS

Aspects of the invention will now be explained in more detail with reference to the drawings, which schematically show embodiments of the device and method according to the present invention.

DETAILED DESCRIPTION OF THE ILLUSTRATIVE EMBODIMENTS

Elements that are identical or performing substantially the same function are denoted by the same numeral.

Figure 1:
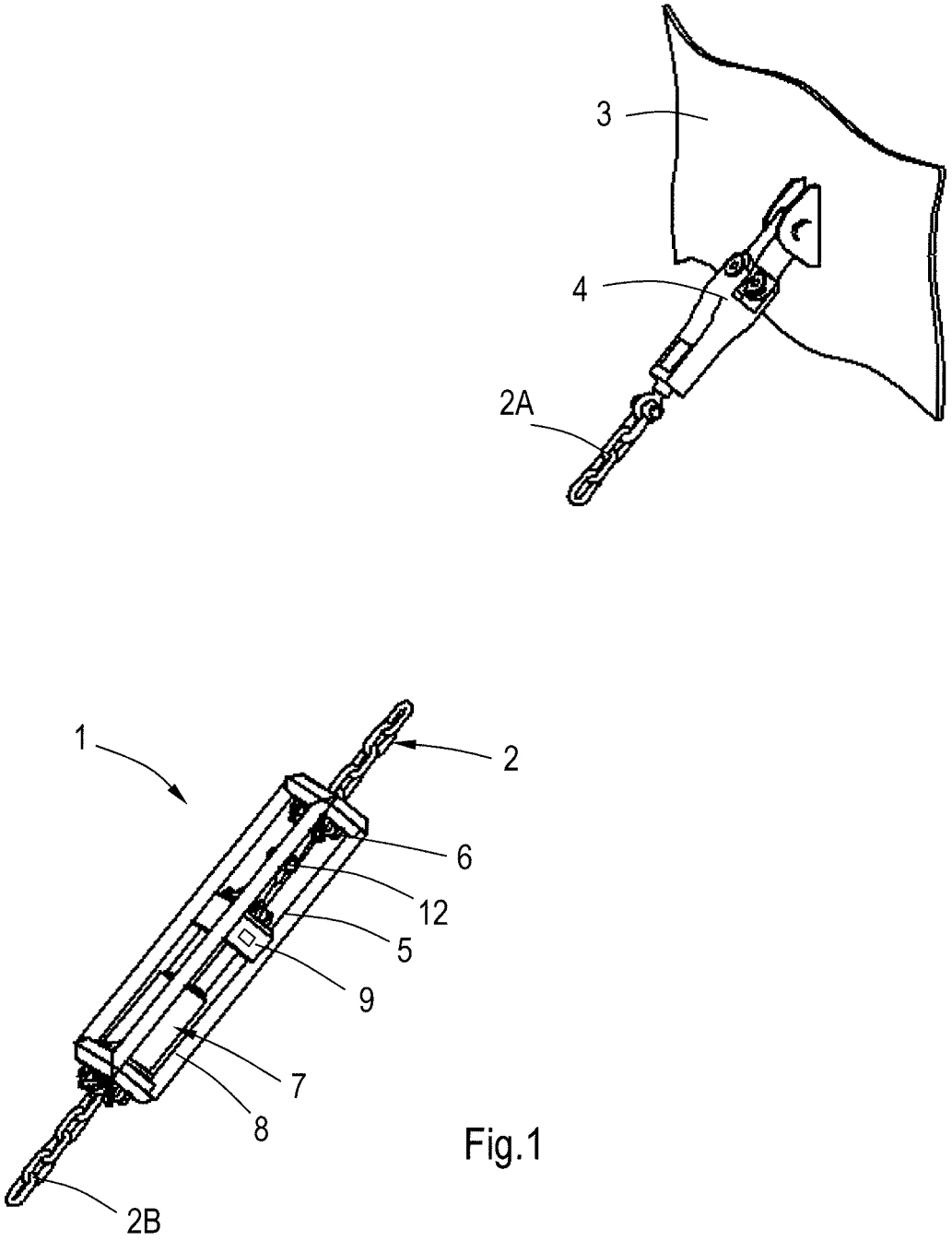
FIG. 1 is perspective view of a first embodiment of a subsea tensioning tool for a mooring leg.

FIG. 1 shows a first embodiment of a subsea tensioning tool 1 (STT) for tensioning the mooring legs 2 of e.g. a floating production, storage and off-loading vessel represented by panel portion 3 (FPSO). The mooring leg 2 comprises a top chain or pendant 2A attached to the vessel 3 by means of a swivel 4 and a lower installation chain 2B secured in the seabed by means of an anchor plate or pile (not shown, but known in itself).

Figure 3A:
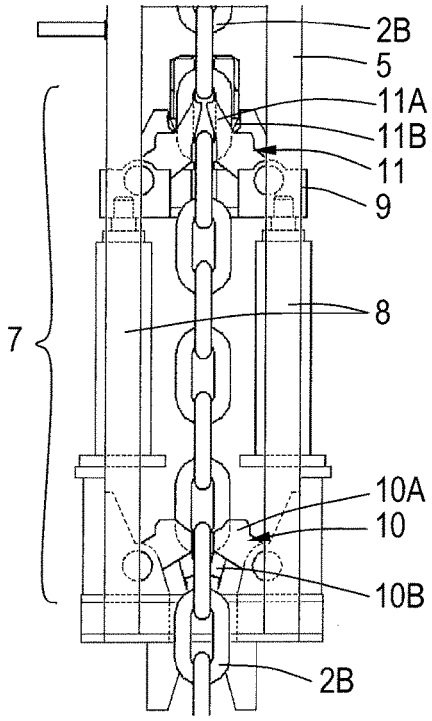
FIGS. 3A to 3C are front views of the second embodiment showing three steps of the tensioning of a mooring leg.
Figure 3B:
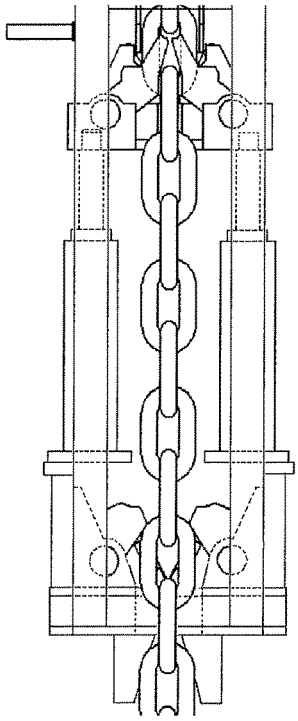
Figure 3C:
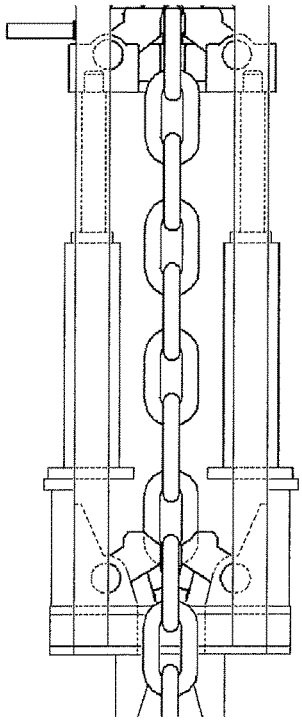

The STT 1 comprises a frame 5 carrying, at its top end, a chain stopper 6 for the pendant 2A and a tensioning mechanism 7, having, in this example, two parallel hydraulic cylinders 8 the lower ends of which are fixed to the lower end of the frame 5 and the upper ends of which are interconnected by a yoke 9 that is slidably mounted inside the frame 5. A chain stopper 10 is fixed to the frame 5 below the hydraulic cylinders 8 and a further chain stopper 11 is mounted on the yoke 9. The installation chain 2B is held by these two chain stoppers 10, 11 (cf. FIGS. 3A to 3B). In this example, each chain stopper 6, 10, 11 comprises a pair of pivotably mounted pawls 10A, 11A operated by hydraulic cylinders 10B, 11B. Details and operation of this tensioning mechanism are shown in and will be explained with reference to FIGS. 3A to 3C.

In FIG. 1, the mooring leg 2 has been tensioned and completed by means of a D-shackle 12 and the subsea tensioning tool 1 is about to be removed. In general, it is preferred that the frame 5 has a U-shaped cross-section to facilitate leading the upper and lower portions of the chain through the STT and to allow removal of the STT from the tensioned and completed chain.

Figure 2:
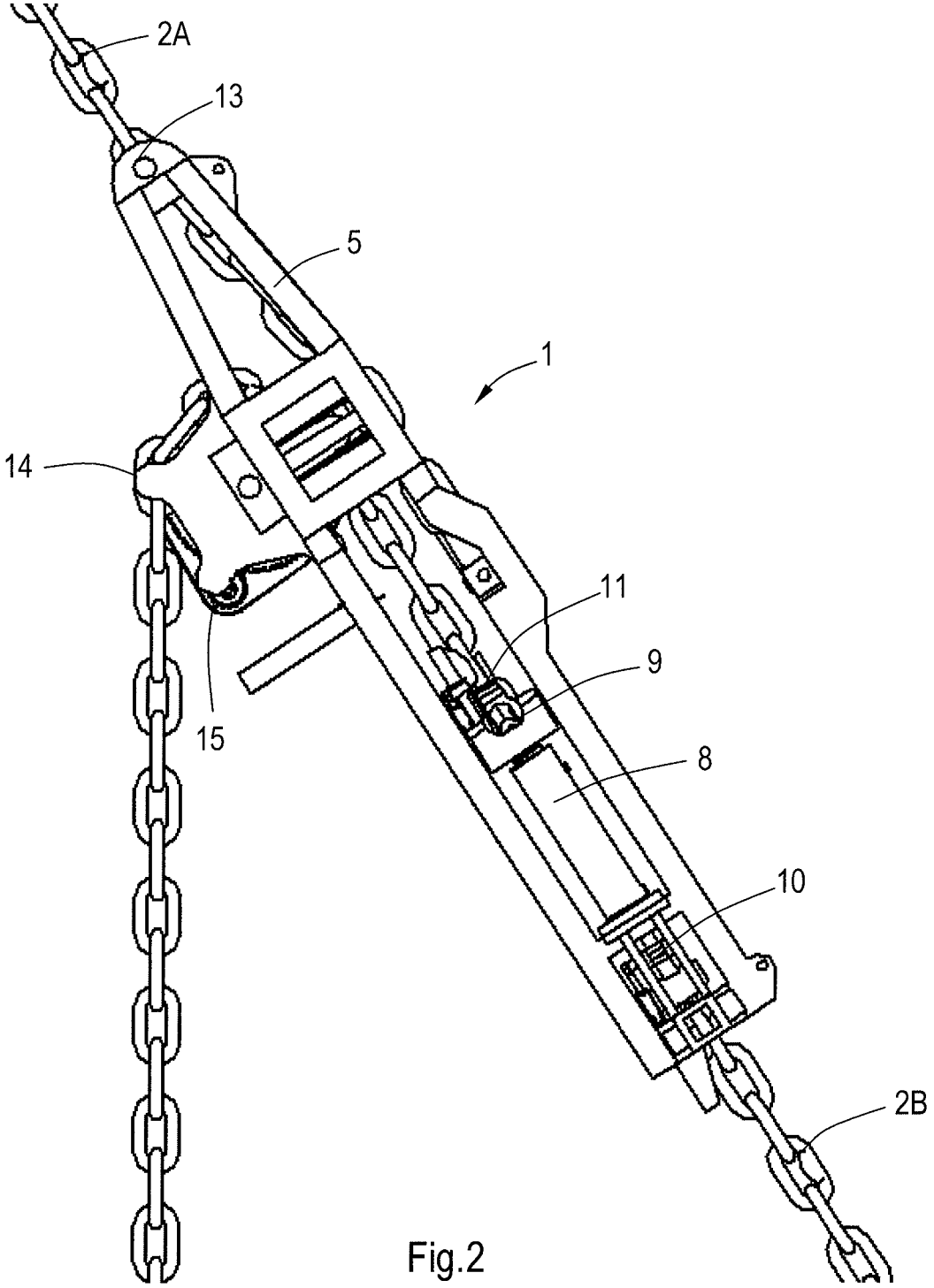
FIG. 2 is a side view of a second embodiment of a subsea tensioning tool for a mooring leg.

FIG. 2 shows a second embodiment of the subsea tensioning tool 1. Instead of a chain stopper as a connector for the pendant 2A, the second embodiment is provided with a hydraulically operated pin 13. Further, it comprises, in addition to the elements described above, a chain handling mechanism, a cutter, and an aligning mechanism.

The chain handling mechanism comprises a so-called "wildcat" 14 (FIGS. 2 and 4) positioned above the yoke 9 and provided with a hydraulic motor 15. The wildcat 14 guides the pulled-in chain away from the tensioning mechanism 7 and generates a pre-tension in the chain between the handling and tensioning mechanisms to provide better control over the position of the links of the pulled-in chain.

The cutter (FIG. 4) comprises a blade saw 16 operated by a hydraulic cylinder 17 positioned between the yoke 9 and the wildcat 14. The cutter simplifies separating pulled-in chain from the tensioned portion of the installation chain 2B.

The aligning mechanism (FIGS. 5A and 5B) comprises a sub-frame 18 for accommodating the end link of the pendant 2A and is movable in the frame 5 by means of hydraulic cylinders 19. In this example, the end link again is a D-shackle 12 and the subframe 18 is provided with a hydraulic cylinder 20 for closing the D-shackle 12.

A mooring line is tensioned as follows. The subsea tensioning tool 1 (STT) is positioned on a fixed frame on a deck of an anchor handling vessel (AHV). The ends of the top chain and the installation chain are brought on board of the AHV. The top chain is secured to the frame by means of the hydraulically operated pin 13 and the D-shackle 12 is positioned in the subframe 18 with its closing pin aligned with the hydraulic cylinder 20 for closing the D-shackle 12. The installation chain 2B is led through the chain stoppers 10, 11, underneath the subframe 18, and over the wildcat 14.

Once the chain portions 2A, 2B are secured in the STT 1, the STT 1 is picked up e.g. by means of an A-frame with its installation wires attached to hoisting eyes on the frame 5. A recovery rope with a buoy attached to it (not shown) is connected to the end link of the installation chain 2B. The pulled-in portion of the installation chain will be suspended from this buoy and be recovered after the mooring line has been completed. The STT is lowered into the sea and to its tensioning start position, e.g. 100 meters away from the vessel 3 to be moored.

At the start of actual tensioning the lower and upper chain stoppers 10, 11 are closed (FIG. 3A) and a predetermined torque is exerted on the wildcat 14 resulting in a pre-tensioning of the chain 2B and taking up any slack. The tensioning cylinders 8 are moved out (FIG. 3B) and the lower chain stopper 10 is urged open by the chain moving upwards. The pulled-in links move along the wildcat 14 to the outside of the frame 5. When e.g. two chain links are pulled in (FIG. 3C), the cylinders 8 are returned to their initial position (FIG. 3A) and the cycle is repeated.

Figure 4:
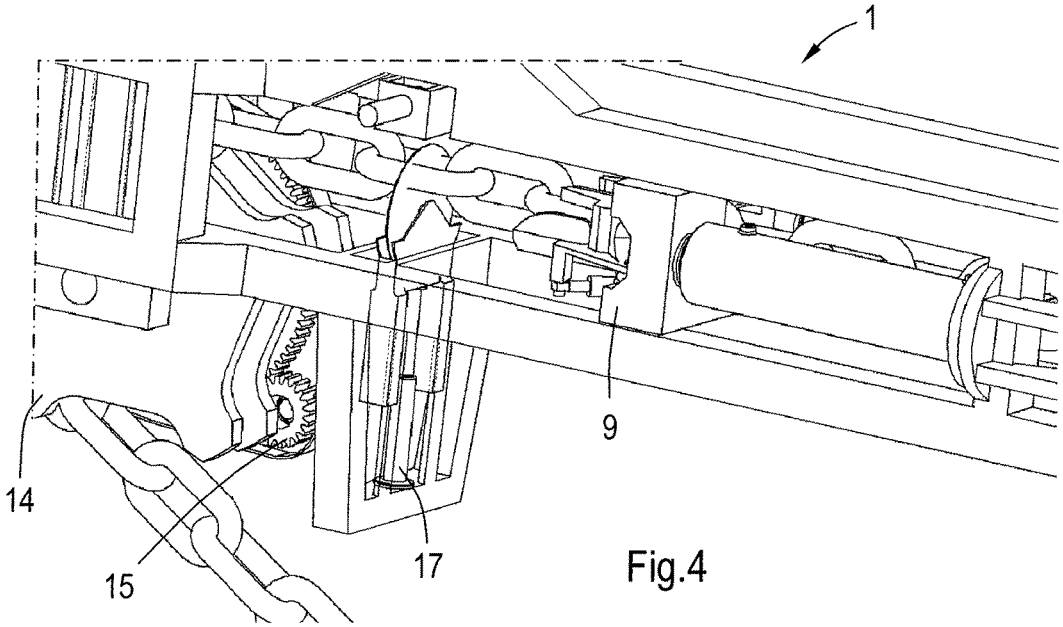
FIG. 4 is a perspective view of the second embodiment showing the cutting off of pulled-in portion of a chain.
Figure 5A:
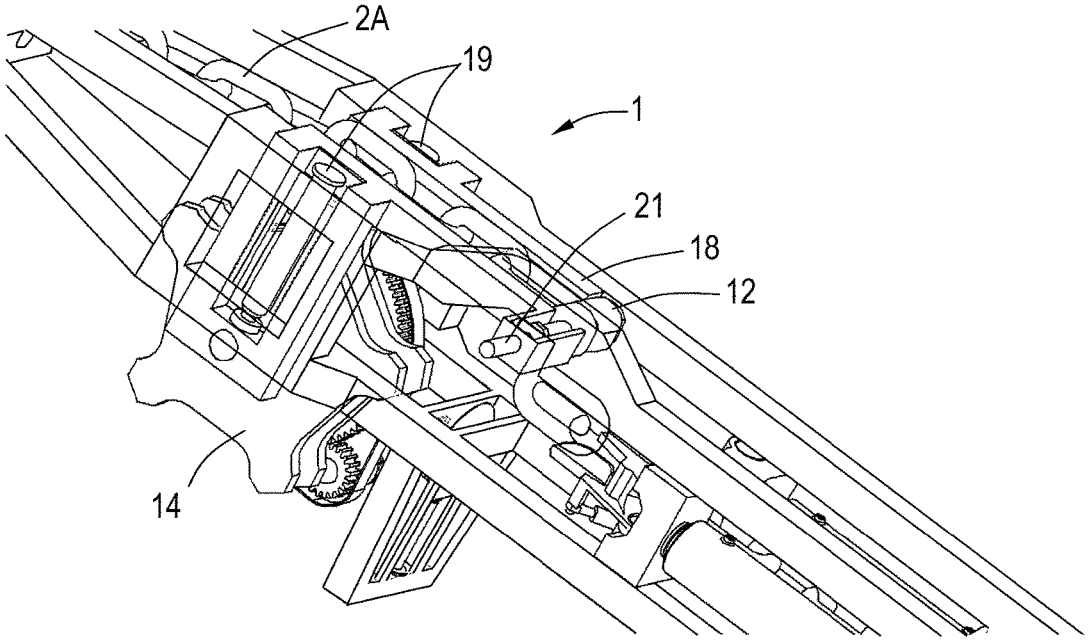
FIGS. 5A and 5B are perspective views of the second embodiment showing the interconnecting of tensioned portions of the chain.
Figure 5B:
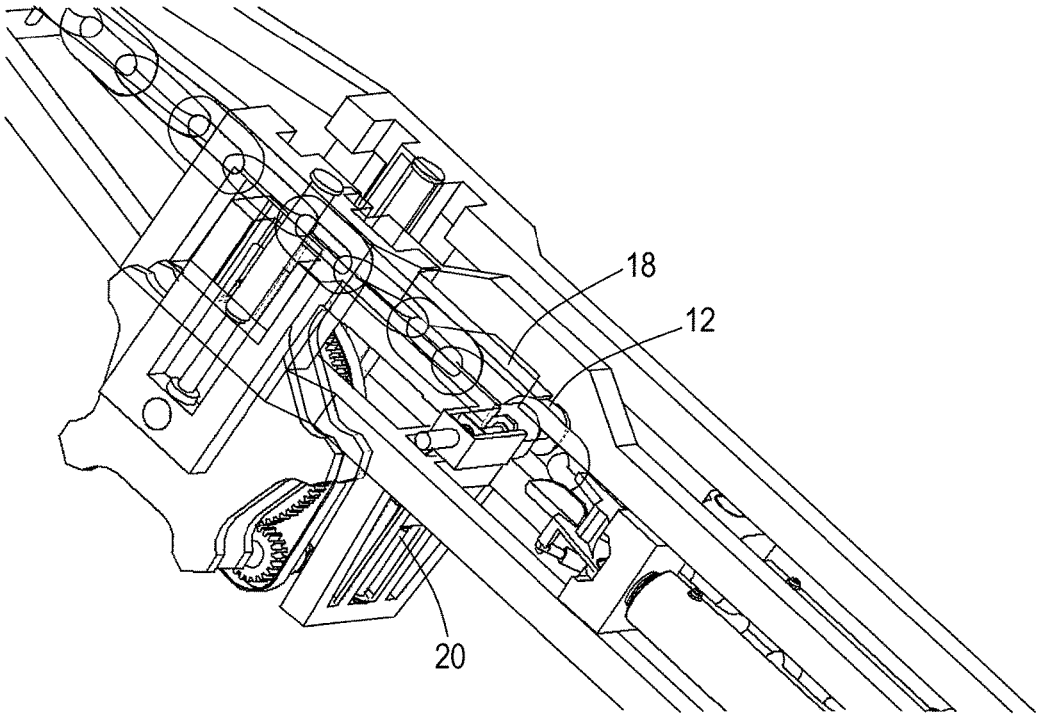
Figure 6:
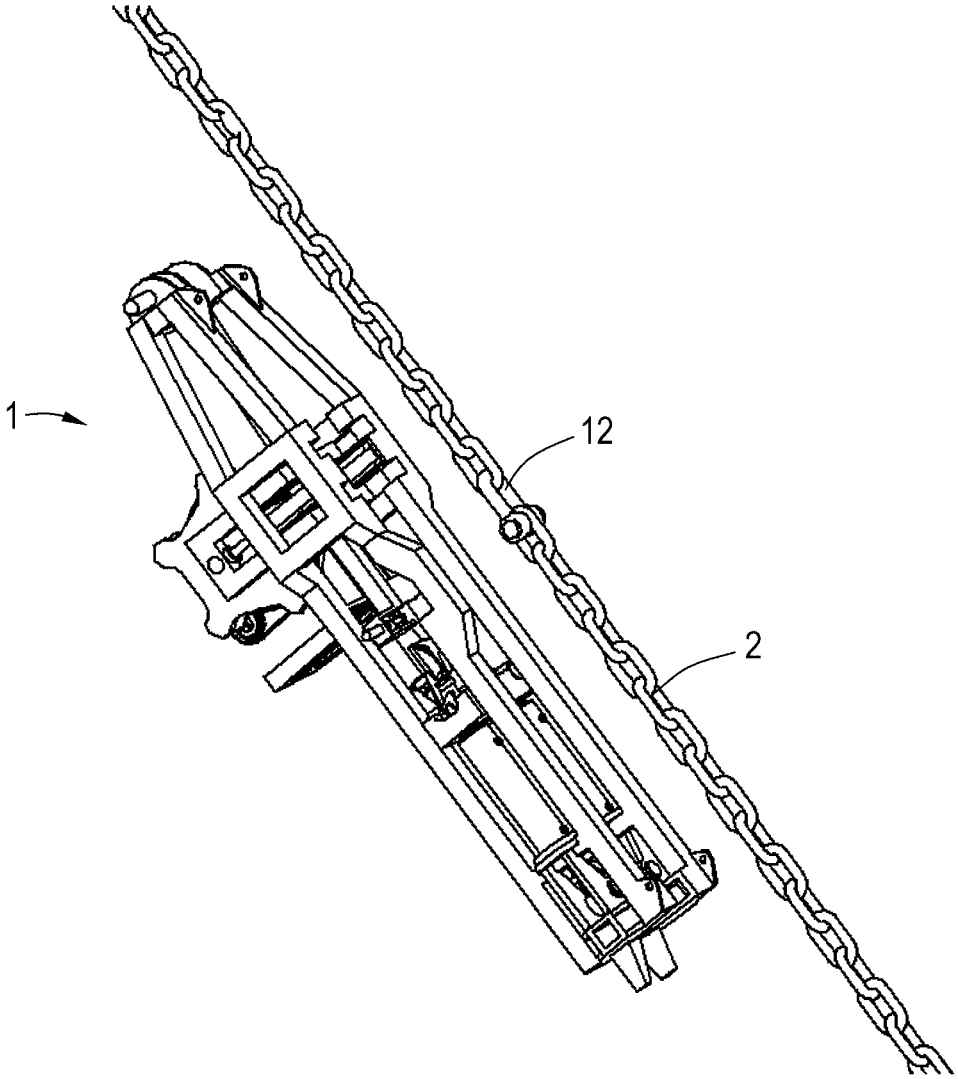
FIG. 6 is a perspective view of the second embodiment, shortly after disengaging from a tensioned mooring line.

If the required tension in the mooring line 2 is reached, the cylinders 8 are once more returned to their initial position (FIG. 3A) and the cutter 16 is activated and moved upwards to cut the chain (FIG. 4). After the installation chain 2B has been cut, the pulled-in portion is removed from the STT by means of the wildcat 14 to eventually hang free under the buoy at a distance from the STT. The chain handling subframe 18 is moved in and the D-shackle 12 is put aligned with the end link of the installation chain 2B (FIGS. 5A and 5B). The hydraulic cylinder 20 for closing the D-shackle 12 is moved out thus pushing the D-shackle pin through the chain and connecting it to the other side of the D-shackle 12.

When the connection is completed, the cylinders 8 in the tensioning mechanism 7 move out a little further so the fixed chain stopper 10 can be opened. Then, the cylinders 8 are moved in again, slightly beyond the initial position shown in FIG. 3A to get any slack out of the D-shackle chain. With the complete chain 2 now tensioned, the upper chain stopper 11 is opened, thus removing the load from the tensioning device. Finally, the upper connection pin 13 is opened and the STT is lowered under the mooring leg 2 and subsequently used to tension and complete further mooring legs.

With this device all tools for tensioning, chain handling, chain cutting, and interconnecting the pendant and installation chain are integrated in a single, submersible and reusable device.

The invention is not restricted to the above-described embodiments, which can be varied in a number of ways within the scope of the claims.

The invention claimed is:

1. A device for tensioning an anchor chain, comprising a frame carrying connectors configured to hold together lower and upper portions of the chain to be tensioned and wherein the frame further carries a tensioning mechanism configured to pull at least one portion of the chain towards the other portion of the chain.

2. The device according to claim 1, wherein the connectors for the lower and upper portions of the chain both releasably engage the chain.

3. The device according to claim 2, wherein at least one of the connectors comprises a chain stopper.

4. The device according to claim 1, wherein the tensioning mechanism comprises one or more jacks, a first chain stopper fixed relative to one end of the one or more jacks and a second chain stopper fixed relative to the other end of the one or more jacks.

5. The device according to claim 1, wherein the frame carries a chain handling mechanism configured to guide a pulled-in chain away from the tensioning mechanism.

6. The device according to claim 1, wherein the frame carries a cutter configured to separate pulled-in chain from a tensioned portion of the chain, and an aligning mechanism configured to align and interconnect ends of the lower and upper portions of the chain.

7. The device according to claim 6, wherein the aligning mechanism comprises a movable sub-frame configured to align ends of the lower and upper portions of the chain.

8. The device according to claim 1, wherein an end of one of the portions of the chain comprises an openable link.

9. The device according to claim 1, wherein the device is removable from the tensioned chain upon disengaging the connectors.

10. A method of tensioning an anchor chain comprising:

releasably connecting lower and upper portions of the chain to a tensioning device, the tensioning device thus temporarily forming a link in the chain, and tensioning the upper and lower portions of the chain with the tensioning device while it is submerged.

11. The method according to claim 10, wherein tensioning comprises pulling the upper and lower portions of the chain towards each other.

12. The method according to claim 11, wherein tensioning comprise tensioning a pulled-in portion of the chain.

13. The method according to claim 10, and further comprising cutting a portion of the chain.

14. The method according to claim 10, and further comprising interconnecting the upper and lower portions of the chain while held in the tensioning device.

15. The method according claim 10, and further comprising removing the tensioning device from the tensioned chain and subsequently using the tensioning device to tension a further chain.

16. The device according to claim 5, wherein the chain handling mechanism is configured to generate a pre-tension in the chain at least between the chain handling mechanism and tensioning mechanism.

17. The device according to claim 1, wherein the frame comprises a substantially U-shaped cross-section.

18. A device for connecting and tensioning an anchor chain, comprising a frame carrying connectors configured to hold disconnected first and second portions of the chain such that the frame forms a link between the disconnected first and second portions, a tensioning mechanism mounted to the frame and configured to pull the first disconnected portion of the chain toward the second disconnected portion of the chain to tension the chain.

19. The device of claim 18 wherein the tensioning mechanism comprises a first part configured to be connected to the first disconnected portion, the first part being movable relative to the frame to pull the first disconnected portion toward the second disconnected portion.

20. The device of claim 19 wherein the tensioning mechanism comprises a second part fixedly secured to the frame, the first part being movable relative to the second part.

21. The device according to claim 18 wherein the connectors include a first connector configured to hold a free end of the disconnected first portion of the chain and a second connector configured to hold a free end of the disconnected second portion of the chain spaced apart from the free end of the disconnected first portion of the chain, and wherein the tensioning mechanism is configured to pull internal links of the disconnected first portion of the chain towards the free end of the disconnected second portion of the chain while maintaining tension between the disconnected first and second portions of the chain.

22. The device according to claim 18 wherein the connectors include a first connector configured to hold a free end of the disconnected first portion of the chain and a second connector configured to hold a free end of the disconnected second portion of the chain spaced apart from the free end of the disconnected first portion of the chain, and wherein the tensioning mechanism is configured to successively pull multiple links of the disconnected first portion of the chain and align an internal link of the disconnected first portion of the chain remote from the free end of the disconnected first portion of the chain with the free end of the disconnected second portion of the chain.

* * * * *